US010113369B1

(12) United States Patent
Barbera

(10) Patent No.: US 10,113,369 B1
(45) Date of Patent: Oct. 30, 2018

(54) CUTTING ASSEMBLY FOR A BORING DEVICE

(71) Applicant: Barbco, Inc., East Canton, OH (US)

(72) Inventor: Anthony R. Barbera, Massillon, OH (US)

(73) Assignee: Barbco, Inc., East Canton, OH (US)

( * ) Notice: Subject to any disclaimer, the term of this patent is extended or adjusted under 35 U.S.C. 154(b) by 0 days.

(21) Appl. No.: 15/633,956

(22) Filed: Jun. 27, 2017

(51) Int. Cl.

| | |
|---|---|
| ***E21B 10/60*** | (2006.01) |
| ***E21B 7/04*** | (2006.01) |
| ***E21B 10/28*** | (2006.01) |
| ***E21B 7/20*** | (2006.01) |

(52) U.S. Cl.
CPC ..... *E21B 10/60* (2013.01); *E21B 7/046* (2013.01); *E21B 7/20* (2013.01); *E21B 10/28* (2013.01)

(58) Field of Classification Search
CPC ..... E21B 10/60; E21B 10/28; E21B 7/046; E21B 7/20; E21B 7/28
See application file for complete search history.

(56) References Cited

U.S. PATENT DOCUMENTS

| | | | | |
|---|---|---|---|---|
| 1,932,068 | A | 10/1933 | Englebright et al. | |
| 3,902,563 | A | 9/1975 | Dunn | |
| 4,043,136 | A | 8/1977 | Cherrington | |
| 4,117,895 | A | 10/1978 | Ward et al. | |
| 5,314,267 | A | 5/1994 | Osadchuk | |
| 5,437,500 | A | 8/1995 | Lehmann et al. | |
| 5,711,385 | A | 1/1998 | Brotherton | |
| 6,682,264 | B1 | 1/2004 | McGillis | |
| 6,902,014 | B1 * | 6/2005 | Estes | E21B 10/086 175/266 |
| 7,389,831 | B2 | 6/2008 | Mullins et al. | |
| 7,992,658 | B2 * | 8/2011 | Buske | E21B 10/28 175/334 |
| 2016/0160566 | A1 * | 6/2016 | Engle | E21B 7/046 175/62 |

* cited by examiner

*Primary Examiner* — D. Andrews
*Assistant Examiner* — Yanick A Akaragwe
(74) *Attorney, Agent, or Firm* — Sand & Sebolt

(57) ABSTRACT

An apparatus and method for drilling an underground borehole where pressurized air may be used to discharge cuttings produced by a cutting assembly. The cutting assembly includes a shaft having a first and second ends and a bore extending between the ends. First and second cutting heads are provided on the shaft a distance apart. The second cutting head is rearward of the first cutting head and is of a greater diameter. Each cutting head defines an air passage therethrough that is in fluid communication with the shaft's bore. A housing extends rearwardly from the second cutting head and connects to a length of casing. An annular flange, concentric with the housing, seals the borehole as the cutting assembly rotates and moves forward through the ground. Cuttings generated by the assembly are moved therethrough and discharged from the casing by pressurized air provided to the assembly through the shaft's bore.

29 Claims, 11 Drawing Sheets

CUTTING ASSEMBLY FOR A BORING DEVICE

BACKGROUND OF THE INVENTION

Technical Field

The invention relates generally to apparatus and methods for drilling generally horizontal boreholes. More particularly, the invention is directed to a cutting assembly in which pressurized air is used to facilitate removal of the spoil or cuttings from the borehole. Specifically, the invention relates to an auger-free cutting assembly comprising first and second cutting heads spaced a distance away from each other along a shaft; where the second cutting head is of a greater diameter than the first cutting head. A housing having an annular flange that seals the borehole extends rearwardly from the second cutting head. Cuttings produced by the first and second cutting heads move under air pressure through passageways defined in the heads, through the housing and are subsequently discharged from the borehole via a casing attached to the housing's rear end.

Background Information

Underground boring machines have been used for many years in the drilling of generally horizontal boreholes. The machines may be used to drill boreholes that are substantially straight and those which are arcuate for the primary purpose of avoiding or bypassing an obstacle. Often such boreholes are formed by initially drilling or otherwise forming a pilot hole of a generally smaller diameter, followed by the use of an enlarged cutting head that follows the path of the pilot hole in order to enlarge the borehole.

In some cases, it may take only one pass in addition to the pilot hole to create the desired final diameter of the borehole. In other cases, the first cutting device is removed from the pilot hole and additional enlarged cutting devices may be used to drill as many passes as necessary to achieve the desired diameter of the borehole.

Many of the boring machines utilize an auger which is rotated in order to force the cuttings or spoil to be removed from the borehole. Such augers may be disposed in a casing and have an outer diameter which is slightly smaller than that of the inner diameter of the casing in which the auger is disposed. Drilling fluid or mud is often pumped into the borehole either within a casing or external to a casing in order to facilitate the cutting process and removal of the cuttings. Drilling fluids or lubricants may involve water, bentonite or various types of polymers, etc. The use of certain types of drilling fluids may present environmental hazards and may be prohibited by environmental laws or regulations in certain circumstances. The inadvertent return of drilling lubricant to the surface, typically referred to as "frac-out", may be of particular concern when the drilling occurs under sensitive habitats or waterways. Although bentonite is non-toxic, the use of a bentonite slurry may be harmful to aquatic plants and fish and their eggs, as these may be smothered by the fine bentonite particles if discharged into waterways.

Other issues faced in drilling applications include that the terrain itself may cause disruptions to drilling. Furthermore, in some instances where boring systems utilize augers to remove the cuttings from the borehole these augers are typically formed in sections that are sequentially added rearwardly as the borehole becomes longer and can accommodate additional auger sections. Given that many boreholes may be several hundred feet long, an auger of such length adds a substantial amount of weight and frictional resistance to the rotation thereof. In some instances it may be necessary to install a product with a required bend radius and the length of the drill required in these instances can be substantial in order to achieve the desired radius.

SUMMARY

There is a need in the art for improvements with respect to boring apparatus and methods to address the above-noted problems.

An apparatus and method for drilling an underground borehole where pressurized air may be used to discharge cuttings produced by a cutting assembly is disclosed herein. The cutting assembly in accordance with an aspect of the present invention includes a shaft having a first and second ends and a bore extending between the ends. First and second cutting heads are provided on the shaft a distance apart. The second cutting head is rearwardly of the first cutting head and is of a greater diameter. Each cutting head defines an air passage therethrough that is in fluid communication with the shaft's bore. A housing extends rearwardly from the second cutting head and connects to a length of casing. An annular flange, concentric with the housing, seals the borehole as the cutting assembly rotates and moves forward through the ground. Cuttings generated by the assembly are moved therethrough and discharged from the casing by pressurized air provided to the assembly through the shaft's bore.

In one aspect, the invention may provide a method comprising steps of providing a cutting assembly comprising a first cutting head and a second cutting head; wherein the second cutting head is spaced a distance rearwardly behind the first cutting head; rotating and moving forward the cutting assembly and a casing extending rearwardly from the cutting assembly to cut an underground borehole; and moving pressurized air rearwardly through a first air passage formed in the first cutting head and through a second air passage formed in the second cutting head and subsequently into a bore defined in the casing to discharge cuttings created by the first and second cutting heads out of a rear end of the casing.

In another aspect, the invention may provide an apparatus comprising an earth-boring cutting assembly having a first cutting head and a second cutting head located rearwardly of the first cutting head; a first air passage extending through the first cutting head; a second air passage extending through the second cutting head; a casing secured to the cutting assembly rearwardly of the second cutting head; wherein the casing extends rearwardly from the cutting assembly; and wherein the casing and cutting assembly are rotatable together as a unit, the casing having a front end and a rear end; wherein the casing defines a bore which extends from adjacent the front end to adjacent the rear end of the case and which is in fluid communication with the first and second air passages.

In another aspect, the invention may provide a cutting assembly for boring through terrain, said cutting assembly comprising a shaft having a first end and a second end; and defining bore that extends from the first end to the second end; a first cutting head provided on the shaft a distance rearwardly of the first end; a second cutting head provided on the shaft a distance rearwardly of the first cutting head; wherein the second cutting head is of a greater diameter than the first cutting head; a first air passage extending through the first cutting head; a second air passage extending through the second cutting head; and wherein the first and second air passages are in fluid communication with the bore of the shaft.

BRIEF DESCRIPTION OF THE SEVERAL VIEWS OF THE DRAWINGS

A sample embodiment of the invention is set forth in the following description, is shown in the drawings and is particularly and distinctly pointed out and set forth in the appended claims.

FIG. 9 is a block diagram showing that the components illustrated in FIG. 9A and FIG. 9B are oriented in a particular manner, and wherein FIGS. 9A and 9B are cross-sections taken along line 9-9 of FIG. 3;

FIG. 9A is a longitudinal cross-section of the front cutting head and the rear cutting head and including a forwardmost portion of a barrel attached to the rear cutting head;

FIG. 9B is a longitudinal cross-section through a middle and rearward portion of the barrel and a forwardmost part of a casing attached to the cutting assembly.

Similar numbers refer to similar parts throughout the drawings.

DETAILED DESCRIPTION

Figure 1A:
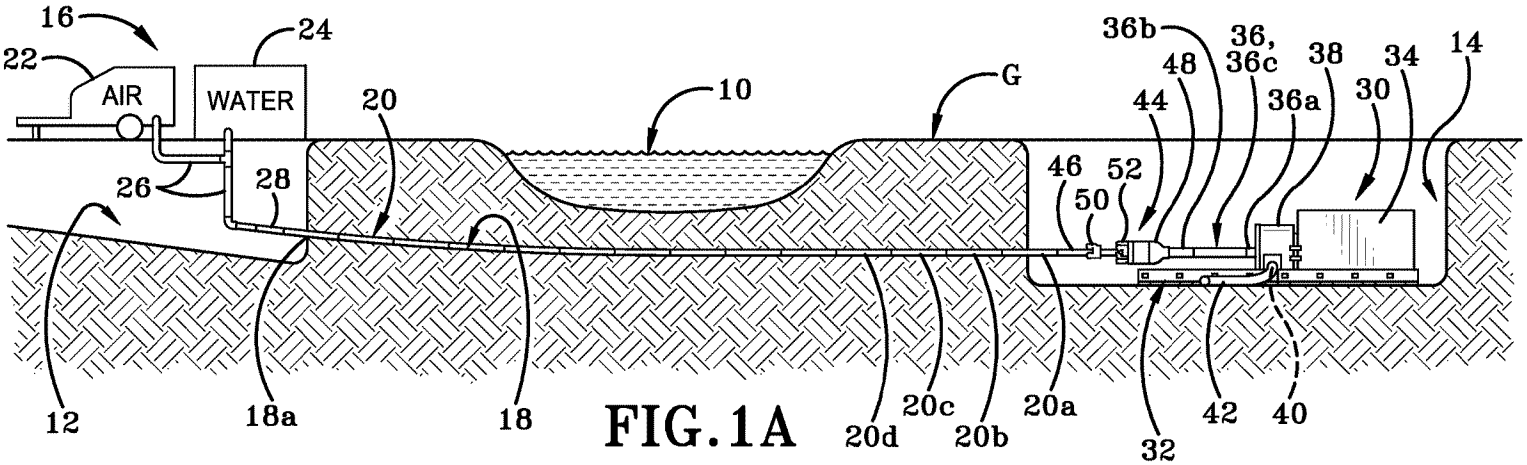
FIG. 1A is a diagrammatic side elevation view of a horizontal directional drilling system with the ground shown in section to illustrate a pilot hole formed in the ground with the pilot tube remaining within the pilot hole.

FIG. 1 shows piece of ground "G" that includes an environmental obstacle 10 under which it is necessary to drill to lay a length of pipe, for instance. The obstacle 10 in this particular instance is illustrated as a body of water such as a stream, river, pond or lake although obstacle 10 will be understood to represent any other type of obstacle such as roads, buildings, walls, trees and so forth such that trenchless or HDD drilling is desirable.

In order to conduct a drilling operation in ground "G", a first pit 12 is dug in the ground "G" on one side of obstacle 10 and a second pit 14 is dug in ground "G" on the opposite side of obstacle 10.

First pit 12 may be used to set up a control assembly 16 that may include a variety of different pieces of equipment at various times. Some of the equipment may be utilized to drill a pilot hole 18 from first pit 12 to second pit 14 and for inserting a pilot tube 20 therein. Pilot hole 18 (and a larger diameter borehole to be discussed later herein) may be of a substantial length such as 50, 75, 150, 200, 250 or 300 feet or more. Thus, first and second pits 12, 14 may be located a distance remote from each other. The method of drilling of pilot tube 18 and the insertion of a pilot tube 20 in pilot hole 18 are known in the art and are therefore not discussed in great detail herein. Pilot tube 20 may be made up of a plurality of pilot tube segments 20*a*, 20*b*, 20*c*, 20*d* and so on, that are connected to one another in an end-to-end fashion and are selectively engageable with and detachable from one another. For instance, each adjacent pair of segments, such as segments 20*a* and 20*b*; and 20*b* and 20*c*, may be joined to one another by a threaded engagement or by any other suitable type of connection known in the art. Each of segments 20*a*, 20*b*, 20*c*, 20*d* etc. defines a bore therein that extends from one end of the segment to the other end thereof. When the various segments are connected together, the pilot tube segment bores are put in fluid communication with one another. Pilot tube 20 thereby defines a bore therethrough that extends from the front end of the pilot tube 20 to the rear end thereof. For the purpose of the present description the front end of pilot tube 20 may be considered to be that part of the pilot tube 20 that is adjacent first pit 12 and the rear end of pilot tube 20 is initially adjacent second pit 14.

In accordance with an aspect of the present invention, control assembly 16 may include an air compressor 22 and a water supply 24 positioned in or adjacent first pit 12. Air compressor 22 and water supply 24 are operatively engaged via hoses or conduits 26 and a swivel connector 28 to pilot tube 20. The hoses or conduits 26 put air compressor 22 and water supply 24 into fluid communication with the bore defined in pilot tube 20. Air compressor 22 and water supply 24 may selectively provide pressurized air and/or water or another fluid, respectively, to pilot tube 20 and thereby to a cutting assembly 44 that is connected to pilot tube 20, as will be described later herein. Preferably in accordance with an aspect of the present invention, only pressurized air is caused to flow through the pilot tube 20 and through cutting assembly 44 to discharge cuttings from a casing 36 attached to cutting assembly 44. Not using water or other liquids to discharge the cuttings produced by cutting assembly 44 aids in preventing frac-out during cutting operations.

Swivel connector 28 permits pilot tube 20 to rotate about a longitudinal axis extending along the length of the tube but that rotation is not transmitted to conduits 26.

Figure 1B:
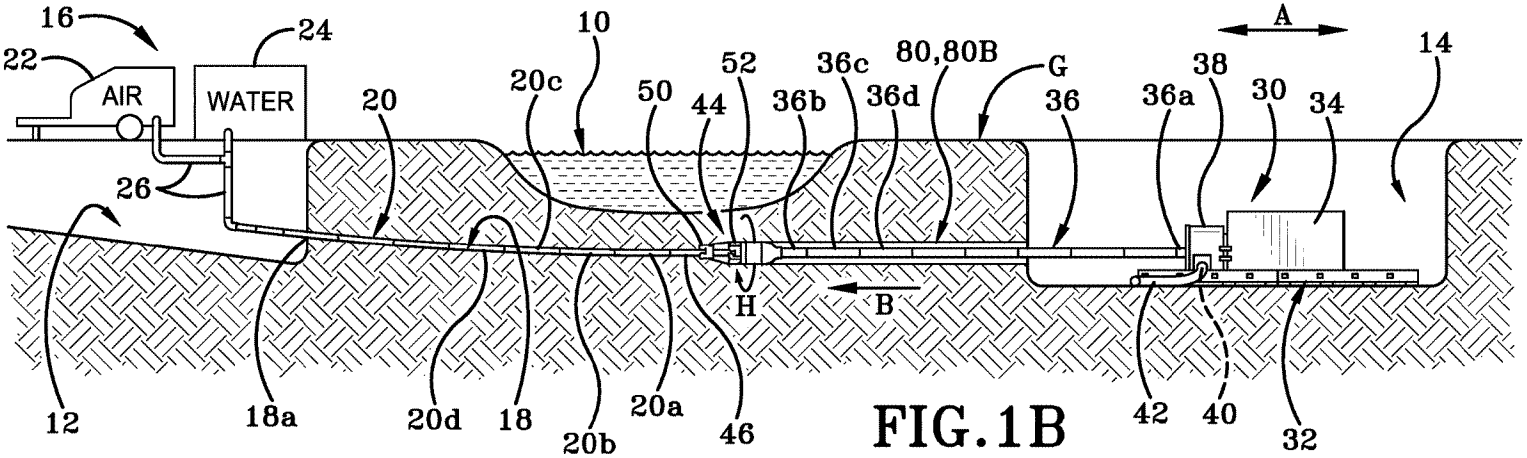
FIG. 1B is a diagrammatic side elevation view of the horizontal directional drilling system with the ground shown in section showing the pilot tube remaining in the pilot hole and showing a cutting assembly in accordance with an aspect of the present invention engaged with the pilot tube and where both the cutting assembly and the pilot tube are rotating within the pilot hole as the cutter assembly advances through the ground.

A horizontal directional drilling (HDD) rig 30 is placed into second pit 14. HDD rig 30 may include tracks 32 (FIG. 1A) that are anchored to ground "G" in the second pit 14. HDD rig 30 is able to move forward and rearward on tracks 32 during a drilling or boring operation. The forward and rearward motion of rig 30 is indicated by arrow "A" in FIG. 1B. While tracks 32 are shown in FIGS. 1A and 1B as being horizontally oriented it will be understood that they may, instead, be angled relative to the horizontal. If this latter situation is the case then the pilot hole 18 at its rear end 18*b* adjacent second pit 14 may be oriented at an angle relative to the horizontal.

Rig 30 may further include an engine 34 that rotates a drive shaft that is coupled to a rearmost segment 36*a* of a casing 36. Rig 30 may further include a front discharge box 38. Casing segment 36*a* may originate within box 38 and extend forwardly out of box 38. Box 38 may also have an outlet or exit port 40 that may have connected to it a discharge conduit or hose 42. During forward and rearward movement of rig 30 as indicated by arrow "A" in FIG. 1A, the engine 34, front discharge box 38, rearward casing segment 36*a* and hose 42 move relative to tracks 32 and ground "G".

When digging second pit 14, a level portion of ground may support rig 30. However, offset to one side of rig 30 the ground may be dug deeper than the level ground upon which rig 30 rests or is supported by. The purpose for digging the ground deeper adjacent one side of rig 30 is to enable the spoils discharged from the outlet or exit port 40 to fill the deeper portion of the pit. Thus, as the earth-boring machine drills a hole from the second pit 14 towards the first pit 12, the outlet spoils fill the deeper portion of the pit and raise it to near the level of the ground upon which rig 30 rests and will be described in greater detail below. When the rig completes its drilling operation, rig 30 may be removed from the second pit 14 and the pit filled in. The advantage of creating a pit with different depth levels reduces the number of parts and components needed to remove excess spoils discharged from outlet port 40 from the pit 14.

Figure 2:
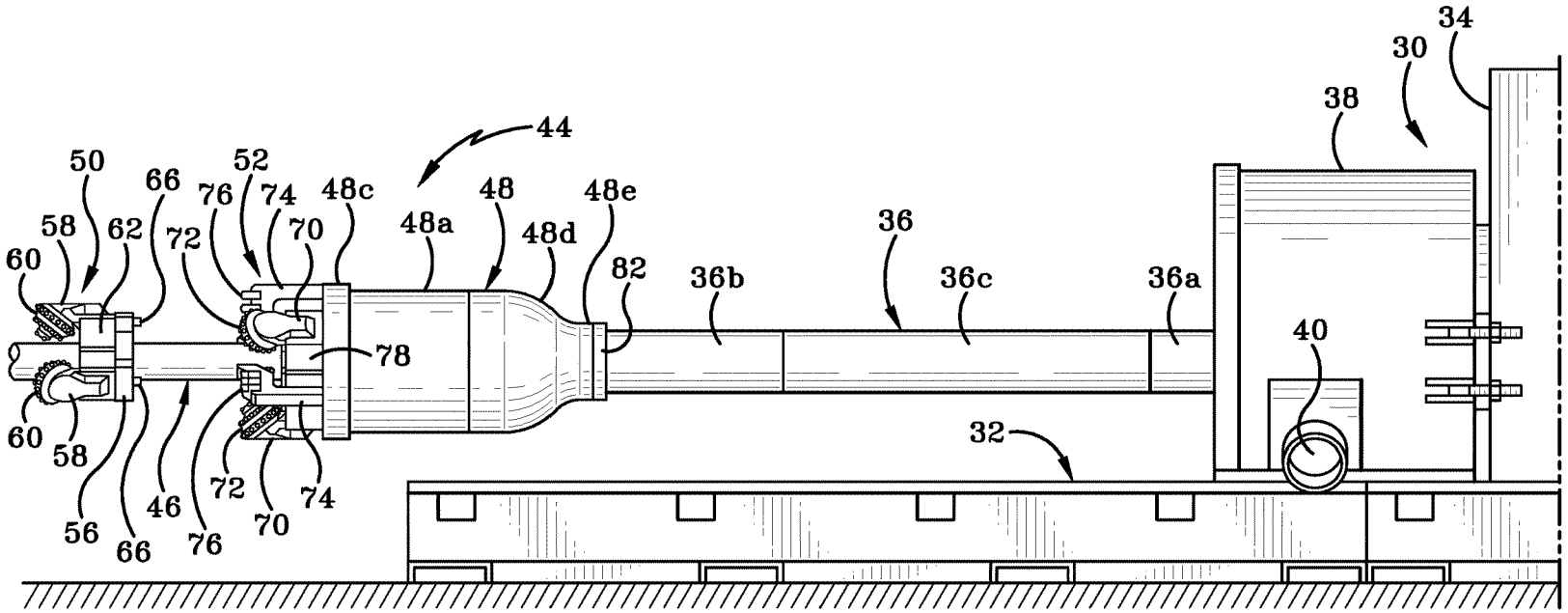
FIG. 2 is a side elevational view showing the cutting assembly in accordance with the an aspect of the present invention extending forwardly from a power drive of a horizontal directional drilling rig.
Figure 3:
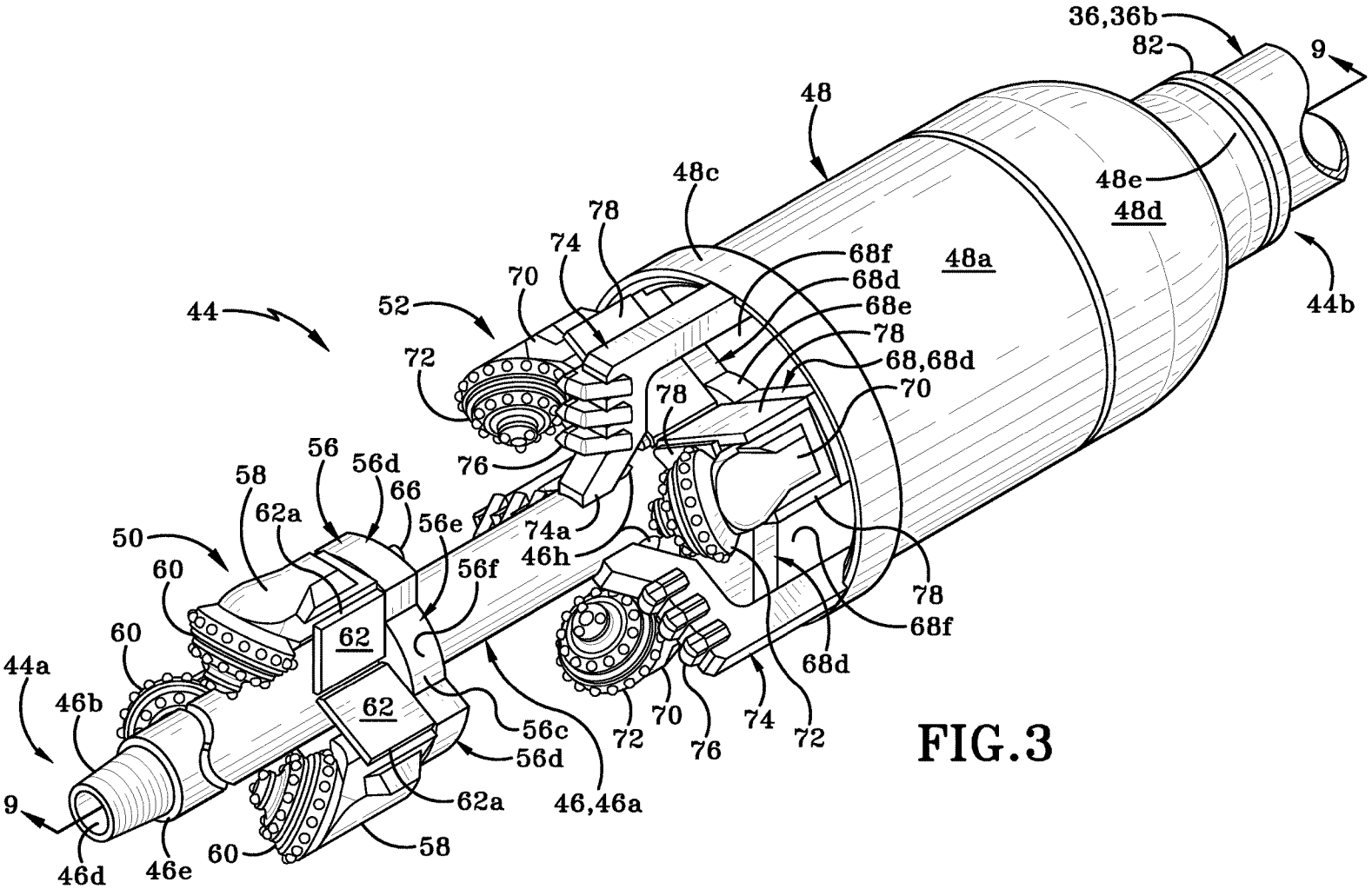
FIG. 3 is an enlarged perspective view of the cutting assembly in accordance with an aspect of the present invention.
Figure 4:
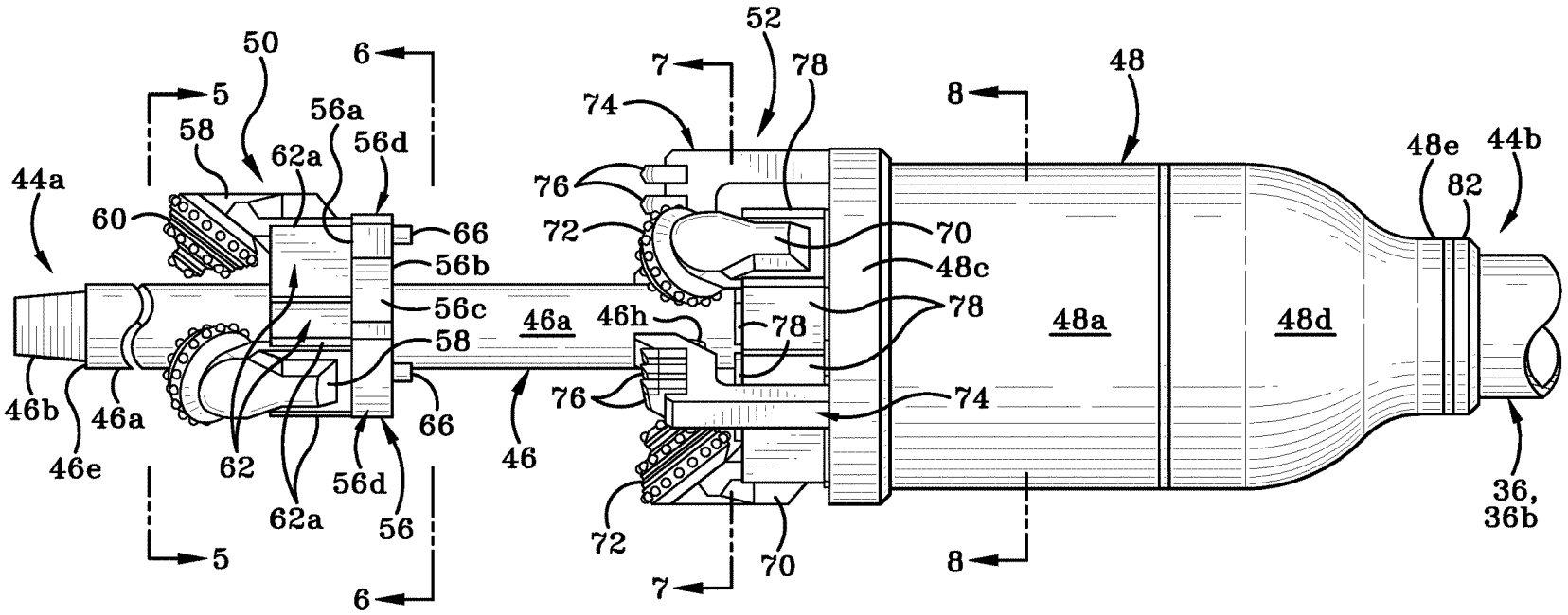
FIG. 4 is a side elevational view of the cutting assembly showing a front cutting head and a rear cutting head thereof.

An earth-boring or cutting assembly 44 in accordance with an aspect of the present invention may be secured between pilot tube 20 and casing segment 36*a*. FIG. 2 and FIG. 3 show that cutting assembly has a front end 44*a* and a rear end 44*b*. Front end 44*a* is secured to pilot tube 20. In particular, cutting assembly 44 includes a central shaft 46 having an annular wall 46*a* with a tapered first end 46*b* that is threaded. First end 46*b* may threadably engage a threaded rear end of pilot tube 20. The rear end of pilot tube 20 will be sized and shaped to receive first end 46*a* therein and will be provided with internal threads to engage first end 46*a*. While FIG. 2 shows that first end 46*b* of shaft 46 is tapered and externally threaded, it will be understood, that the rear end of pilot tube 20 may, instead, be tapered and provided with external threads and that the first end 46*b* of shaft 46 may include an internally threaded bore into which the rear end of pilot tube 20 is received.

While engaged with pilot tube 20, cutting assembly 44 will advance and cut through the earth in the direction indicated by arrow "B" in FIG. 1B, i.e., in a direction from second pit 14 towards first pit 12. As the cutting operation progresses and cutting assembly 44 moves towards first pit 12, segments of pilot tube 20 are successively removed. At the same time additional casing segments, such as segments 36*b*, 36*c*, and 36*d* will be successively added between cutting assembly 44 and the rearmost casing segment 36*a*. In other words, as cutting advances in the direction of arrow "B", the pilot tube 20 progressively gets smaller and the casing 36 (made up of casing segments 36*a*, 36*b*, 36*c*, 36*d* etc. will get longer. The casing segment 36*b* will be referred to in this description as forwardmost casing segment 36*b*.

Cutting assembly 44 is shown in greater detail in FIGS. 2-10. Cutting assembly 44 comprises, in addition to shaft 46, a housing 48, a front cutting head 52, and a rear cutting head 52.

Figures 9, 9A:
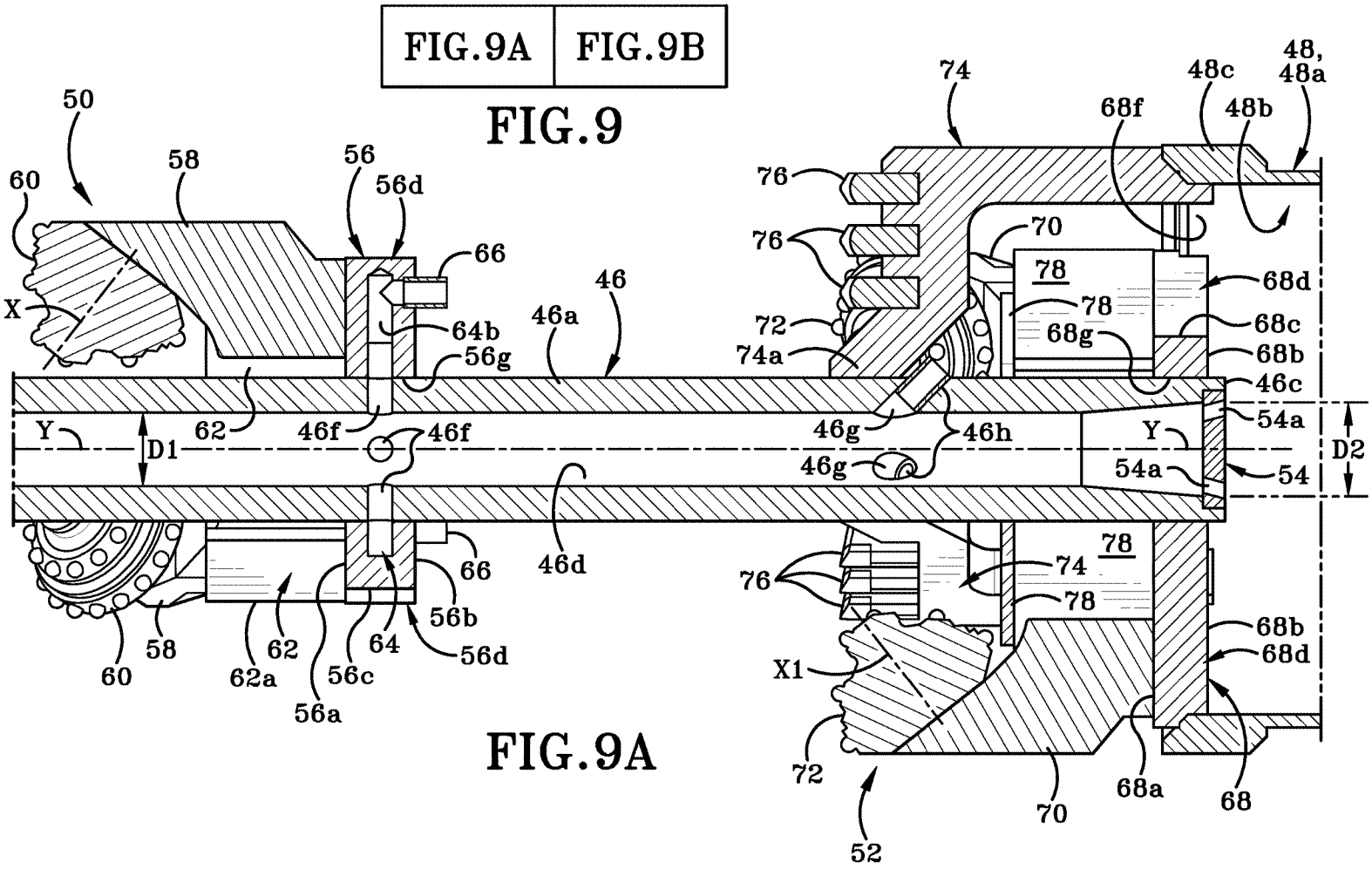

Referring to FIGS. 3 and 9A, shaft 46 is a cylindrical member having annular wall 46*a*, the tapered first end 46*b* and a second end 46*c* located a distance from first end 46*b*. Shaft 46 has a longitudinal axis "Y" (FIG. 9A) that extends between first and second ends. A longitudinal bore 46*d* is defined by an inner surface of wall 46*a* and extends from first end 46*b* to second end 46*c*. As indicated previously herein, first end 46*b* may taper in diameter and be threaded so as to be selectively engaged with a complementary rear end of a rearmost one of the pilot tube segments of pilot tube 20. First end 46*b* may define an annular shoulder 46*e* that is brought into abutting engagement with an end region of pilot tube 20. When first end 46*b* is engaged with pilot tube 20, the bore defined in pilot tube 20 is placed in fluid communication with bore 46*d* of shaft 46. Consequently, bore 46*d* is placed in fluid communication with conduits 26 and thereby with air compressor 22 and water source 24. Air provided by air compressor 22 and/or fluid from water source 24 (i.e., water or other fluids such as bentonite) may be caused to flow through the bore in pilot tube 20 and subsequently through bore 46*d* of shaft 46 when air compressor 22 and/or water source 24 are actuated.

Figure 7:
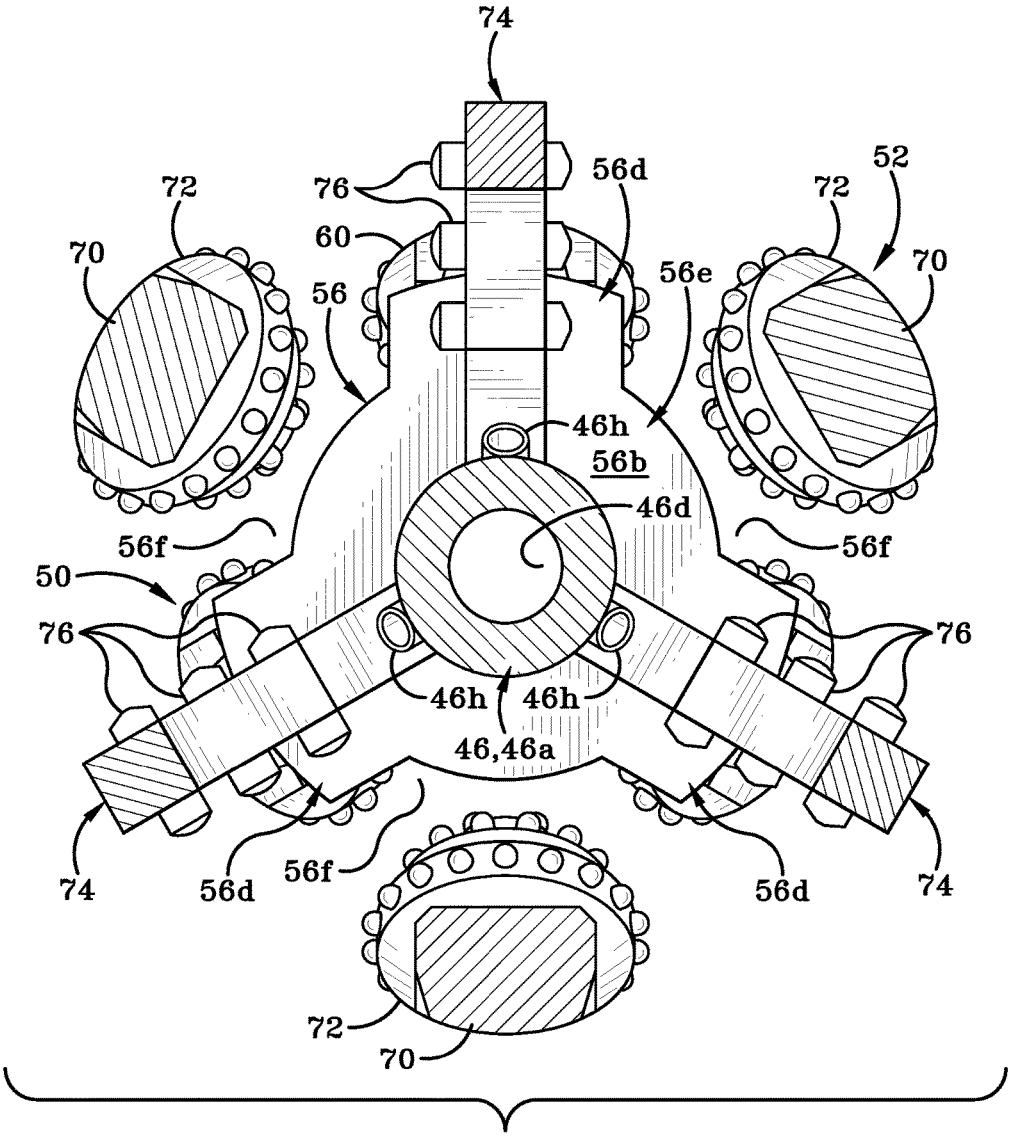
FIG. 7 is rear end view of a forwardmost region of the rear cutting head taken along line 7-7 of FIG. 4.
Figure 9B:
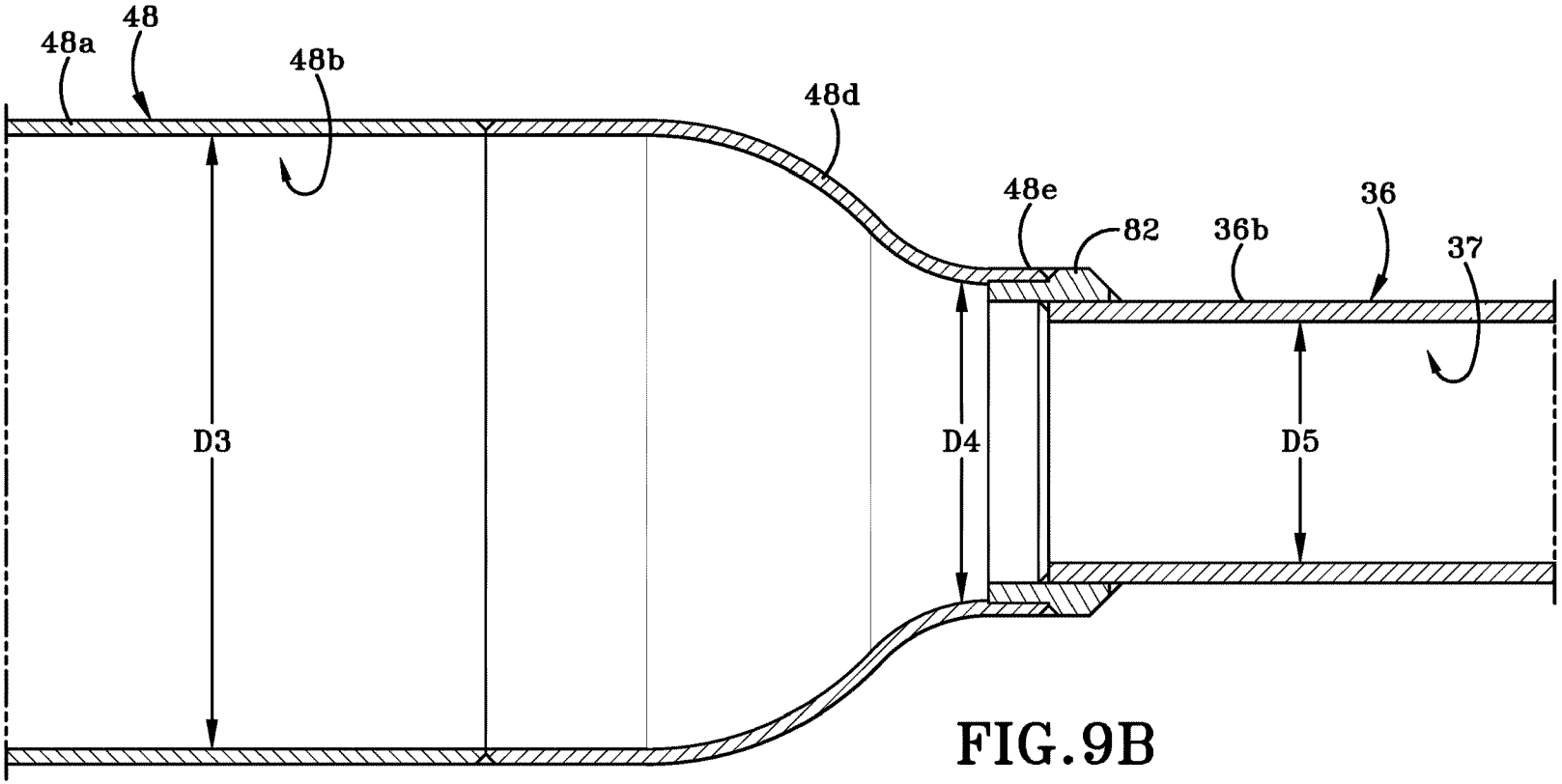

As best seen in FIGS. 9A and 9B, a first air passage and a second air passage are defined in first cutting head 50 and second cutting head 52, respectively. These first and second air passages are in fluid communication with bore 46*d* of shaft 46 and thereby with the bore of pilot tube 20. A plurality of, first apertures 46*f* and a plurality of second apertures 46*g* are defined in annular wall 46*a* of shaft 46 and these first and second apertures 46*f*, 46*g* extend between the inner surface of annular wall 46*a* and an exterior surface thereof. First apertures 46*f* are spaced a distance away from second apertures 46*g*. First apertures 46*f* may be oriented generally at right angles to longitudinal axis "Y" of shaft 46. Second apertures 46*g* may be oriented at an acute angle to longitudinal axis "Y" and nozzles 46*h* may extend outwardly from second apertures 46*g* for a distance. Shaft 46 may define three first apertures 46*f* therein and three second apertures 46*g* therein. Consequently, three nozzles 46*h* may extend radially outwardly from an exterior surface of annular wall 46*a* as can be seen in FIG. 7. Second air passage comprises second apertures 46*g* and nozzles 46*h*. It will be understood that shaft 46 may be fabricated to include fewer or more first apertures 46*f* and second apertures 46*g* and may even be provided with additional apertures along the length of shaft 46.

Shaft 46 has a substantially constant internal diameter "D1" (FIG. 9A) for most of the length of shaft, where the length is measured from first end 46*b* to second end 46*c*. As indicated earlier herein, first end 46*b* tapers from diameter "D1" to a diameter smaller than "D1". Conversely, the internal diameter of shaft 46 proximate second end 46*c* becomes progressively larger as can be seen in FIG. 9A. The internal diameter of shaft 46 at second end 46*c* is of a diameter "D2" which is greater than "D1".

Figure 8:
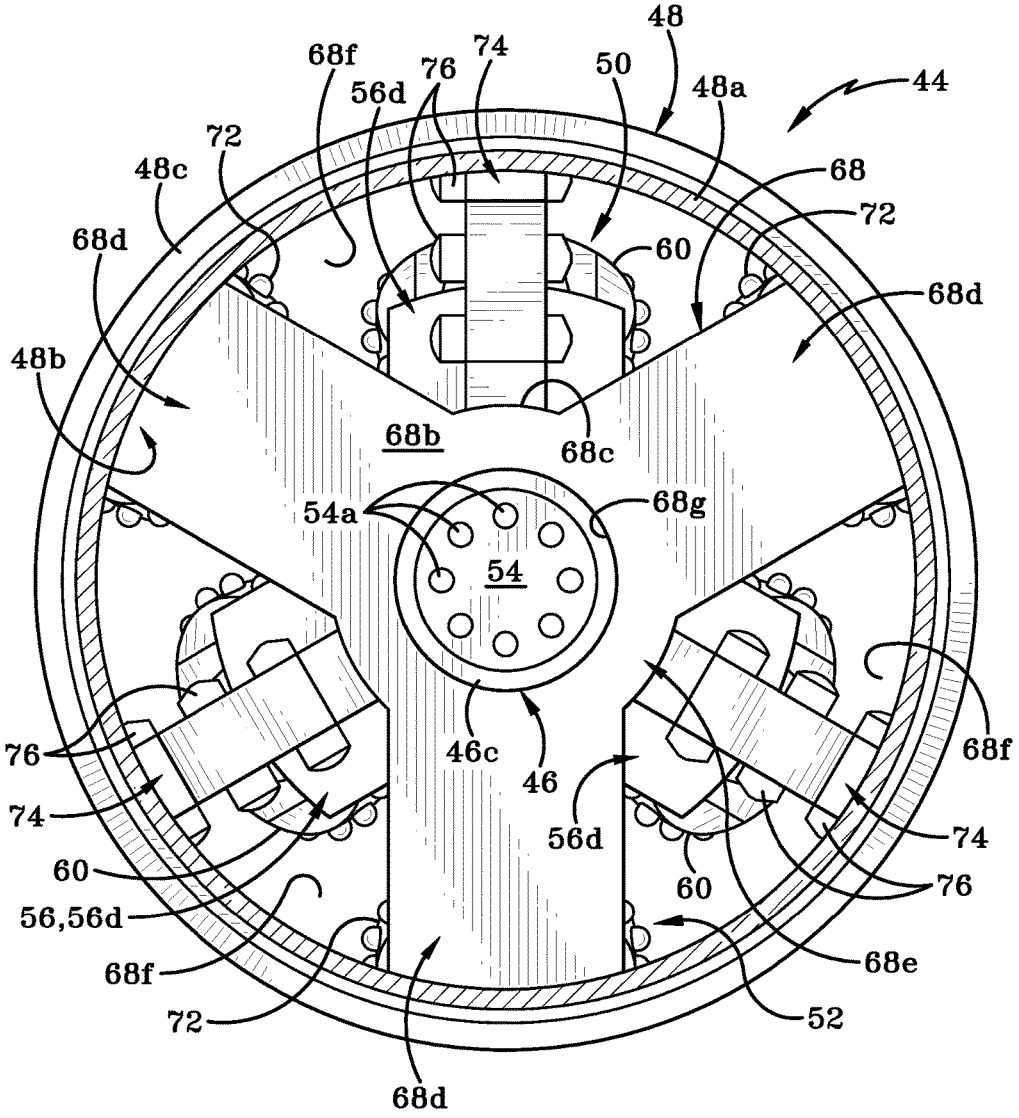
FIG. 8 is a rear end view of middle region of the rear cutting head taken along line 8-8 of FIG. 4.

A plate 54 is provided at second end 46*c* of shaft 46 and this plate 54 extends across an opening to bore 46*d* defined in second end 46*c* of shaft and closes off access thereto. Plate 54 may be engaged with second end 46*c* in such a way that the plate 54 may be removed and replaced from time to time. FIGS. 8 and 9A show that a plurality of holes 54*a* are defined in plate 54 and these holes 54*a* extend between an interior and exterior surface of plate 54. Holes 54*a* are arranged in an exemplary pattern but it should be understood that any desired configuration and number of holes 54*a* may be provided in plate 54. Pressurized air or fluid flows into bore 46*d* through first end 46*b* of shaft 46 and this air or fluid flows through bore 46*d* in a first direction indicated by arrows "C" in FIG. 10. Holes 54*a* allow some air or fluid flowing through bore 46*d* to exit from bore 46*d*. The flow of exiting air or fluid is indicated by arrows "D" in FIG. 10. However, because there are solid regions on plate 54 that are located between the various holes 54*a*, a quantity of the air or fluid flowing through bore 46*d* in the direction "C" hits plate 54. This creates a back-pressure in bore 46*d* and the back-pressure is indicated by the arrows "E" in FIG. 10. The combination of air and fluid flow in the direction of arrow "C" and the back-pressure "E" causes air or fluid to be forced out of first apertures 46*f* and second apertures 46*g* and their associated nozzles 46*h*. The air or fluid flow out of first apertures 46*f* as indicated by arrows "F" in FIG. 10 and the air or fluid flow out of nozzle 46*h* is indicated by arrows "G".

It has been found that plates 54 having different patterns of holes 54*a* therein create different speed and pressure air and fluid flow from first apertures 46*f*, second apertures 46*g* and holes 54*a*. The operator will select one of a plurality of differently configures plates to engage with cutting assembly 44. Each of these plates may differ in the number and pattern of holes 54*a* provided therein. After selecting an appropriate plate for the specific type of terrain through which cutter assembly 44 will bore, the operator will engage the appropriate plate 54 on the second end of shaft 46. This will be further discussed later herein.

As disclosed earlier herein cutting assembly 44 also comprises a front cutting head 50, a rear cutting head 52 and a housing 48. Front cutting head 50 and rear cutting head 56 are mounted on shaft 46 with front cutting head 50 being located between first end 46*b* of shaft 46 and rear cutting head 52. Front cutting head 50 is spaced a distance rearwardly from first end 46*b* and rear cutting head 52 is spaced a distance rearwardly from front cutting head 50. There is thus a gap between a rear region of front cutting head 50 and a front region of rear cutting head 52. Housing 48 is engaged with rear cutting head 52 and with forwardmost casing segment 36*a*.

Figure 5:
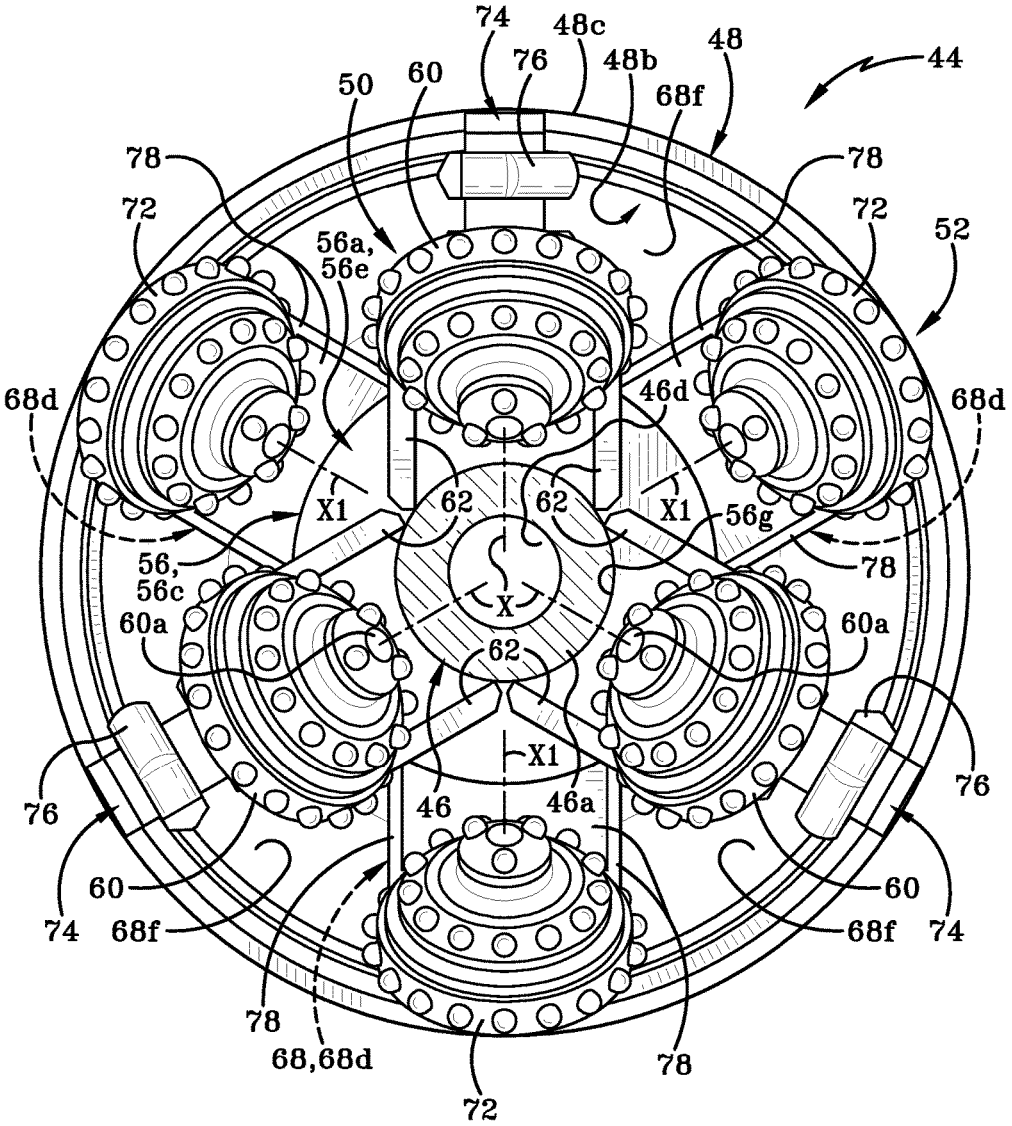
FIG. 5 is a front end view of the cutting head taken along line 5-5 of FIG. 4.
Figure 6:
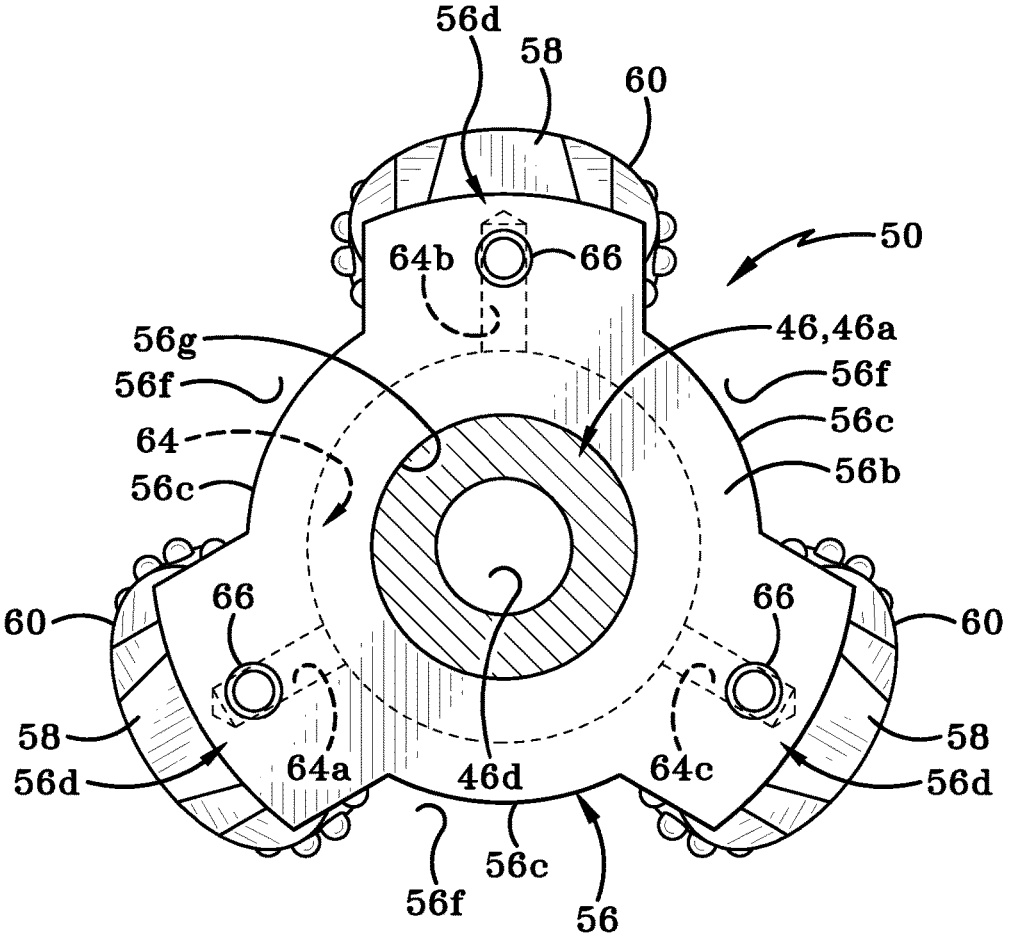
FIG. 6 is a rear end view of the front cutting head taken along line 6-6 of FIG. 4.

As is evident from FIGS. 2 and 3A, front cutting head 50 is of a smaller exterior diameter than rear cutting head 52. Front cutting head 50 includes a mounting plate 56, a plurality of arms 58 with roller cones 60 mounted thereon, and a plurality of V-shaped plates 62. As best seen in FIG. 9A, mounting plate 56 has a front surface 56*a*, a rear surface 56*b* and a peripheral wall 56*c* extending between front and rear surfaces 56*a*, 56*b*. FIG. 6 shows that mounting plate 56 includes three legs 56*d* that radiate at intervals outwardly from a generally circular central region 56*e*. Legs 56*d* may be oriented at about 120° relative to each other. This means that a gap 56*f* is defined between each pair of adjacent legs 56*d*. A central hole 56*g* is defined in mounting plate 56 and shaft 46 passes through central hole 56*g* as can be seen in FIG. 5. Various parts of front cutting head 50, particularly central region 56*e* of mounting plate 56, are welded or otherwise secured to the exterior surface of shaft 46. Because of this, front cutting head 50 and shaft 46 move in unison with each other. When shaft 46 is rotated about the longitudinal axis "Y" as indicated by arrow "H" in FIG. 1B, shaft 46 and front cutting head 50 both rotate in the direction of arrow "H" or in the opposite direction to arrow "H".

As best seen in FIGS. 6 and 9A, a first air passage 46*f*, 64, 64*a*, 64*b*, 64*c* is defined in first cutting head 50. Passage 64 and its a plurality of branches 64*a*, 64*b*, 64*c* are defined within the interior of mounting plate 56 of first cutting head 50 in a location that may be generally midway between front surface 56*a* and rear surface 56*b* of mounting plate 56. Each branch 64*a*, 64*b* and 64*c* is located in one of the legs 56*d* of mounting plate 56 and passage 64 is located in circular central region 56*e* and may be generally circular in shape. As best seen in FIG. 9A, each branch 64*a*, 64*b*, 64*c* may be generally L-shaped when viewed from the side and terminates in an opening in rear surface 56*b* of mounting plate 56. A nozzle 66 may be seated in each of these openings. Passage 64, the branches 64*a*, 64*b* and 64*c* thereof and nozzles 66 are located in mounting plate 56 so as to be in fluid communication with the first apertures 46*f* in shaft 46, thereby forming the first air passage in first cutting head 50. Some of the air or fluid flowing through bore 46*d* of shaft 46 may be diverted via first apertures 46*f* into passage 64, through branches 64*a*, 64*b*, 64*c* and out of the associated nozzles 66 as indicated by arrow "F" and into the space between front cutting head 50 and rear cutting head 52. The pressurized airflow picks up cuttings 84 created by first cutting head 50 and blows those cuttings 84 rearwardly towards second cutting head 52.

Each of the plurality of arms 58, is are mounted on mounting plate 56 in such a way that they extend outwardly away from front surface 56*a* in a direction that is generally parallel to the longitudinal axis "Y" of shaft 46. A roller cone 60 is mounted proximate a free end of each arm 58 in such a way that roller cone 60 may rotate about an axis "X" (FIG. 9A) that passes through a central region 60*a* (FIG. 5) of the roller cone 60 and into the free end of the associated arm 58, Roller cone 60 may be of a configuration such as is illustrated in the attached figures but it will be understood that other types of cutters may be utilized in the place of roller cones 60 depending on what is required by any particular terrain, ground or rock that needs to be bored into by cutting assembly 44.

The two plates that make up each V-shaped plate 62 are mounted on an exterior surface of shaft 46 and onto front surface 56*a* of mounting plate 56. In particular, each V-shaped plate 62 is mounted to part of the generally circular region 56*e* of mounting plate 56 that extends between two adjacent legs 56*d*. The outer edges 62*a* of each plate are oriented generally parallel to longitudinal axis "Y". When shaft 46 rotates about longitudinal axis "Y" and roller cones 60 rotate about their axes "X", the roller cones 60 and edges 62*a* of plates 62 cut and grind away the ground "G" through which cutting assembly 44 is being advanced. The plates 62 are located in the spaces between adjacent roller cones 60 and so cut and ground material passes into these spaces and is guided by V-shaped plates 62 downwardly toward rear cutting head 52. As will be described later herein this rearward movement of cut and ground material is aided in moving rearwardly by air or fluid that exits front cutting head 50 through nozzles 66 and is swept backwardly by the air or fluid towards rear cutting head 52.

As is evident from FIGS. 2 and 3A, rear cutting head 52 is of a greater exterior diameter than front cutting head 50. Rear cutting head 52 includes a mounting plate 68, a plurality of arms 70 with roller cones 72 mounted thereon, a plurality of legs 74 with cutting teeth 76 mounted thereon and a plurality of V-shaped plates 78.

As best seen in FIG. 9A, mounting plate 68 has a front surface 68, a rear surface 68*b* and a peripheral wall 68*c* extending between front and rear surfaces 68*a*, 68*b*. FIG. 8 shows that mounting plate 68 includes three legs 68*d* that radiate at intervals outwardly from a generally circular central region 68*e*. Legs 68*d* may be oriented at about 120° relative to each other. This means that a gap 68*f* is defined between each pair of adjacent legs 68*d*. A central hole 68*g* is defined in mounting plate 68 and shaft 46 passes through central hole 69*g* as can be seen in FIG. 8. Various parts of rear cutting head 52, particularly central region 68*e* of mounting plate 68, are welded or otherwise secured to the exterior surface of shaft 46. Because of this, rear cutting head 52 and shaft 46 move in unison with each other.

FIG. 8 shows that mounting plate 56 of front cutting head 50 and mounting plate 68 of rear cutting head 52 are offset relative to each other. This means that each of the legs 68*d* of mounting plate 68 of rear cutting head 52 is positioned to fall in one of the gaps 56*f* defined between adjacent legs 56*d* of front cutting head 50. Furthermore, each of the legs 56*d* of mounting plate 56 of front cutting head 50 is positioned to fall in one of the gaps 68*f* defined between adjacent legs 68*d* of rear cutting head 52.

The arms 70 extend longitudinally outwardly away from the front surface 68*a* of mounting plate 68 and a roller cone 72 is mounted for rotation on the free end of each arm in much the same way as the roller cones 60 are mounted on the arms 58. Additionally, the legs 74 extend longitudinally outwardly away from the front surface 68*a* of mounting plate 68. Each leg 74 is generally L-shaped when viewed from the side (FIG. 9A) having a first section and a second section. The first section extends outwardly from mounting plate 68 and the second section is oriented generally parallel to upper surface 68*a* of mounting plate 68 and extends inwardly towards shaft 46. The terminal end 74*a* (FIG. 9A) of the second section of each leg 74 is welded to the exterior surface of the wall 46*a* of shaft 46 immediately forwardly of one of the nozzles 46*h* that extends outwardly from shaft 46. A plurality of cutting teeth 76 is provided on each of the second sections of the three legs 74. Teeth 76 are oriented generally at right angles to the associated second section of the associated leg 74.

Rear cutting head 52 also includes three pairs of V-shaped plates 78 that are mounted to the exterior surface of shaft 46 at the apex of the V-shape. The plates 78 are also welded to the front surface 68*a* of mounting plate 62. Each V-shaped plate 78 is located in the gap 68*f* between adjacent legs 68*d* of mounting plate 68. Plates 78 are located generally aligned beneath legs 74 and teeth 76 and are positioned to guide cut material into the spaces defined between legs 68*d* of mounting plate 68. This can best be seen in FIG. 3.

When shaft 46 is rotated about longitudinal axis "Y" and the roller cones 72 are rotated about their respective "X1" axes (FIG. 9A), the roller cones 72 and cutting teeth 74 and the edges of plates 78 aid in tearing, cutting and grinding away soil and rocks that they encounter.

Because of the offset between the legs 56*d* and 68*d* of the mounting plates 56, 68 of the front and rear cutting heads 50, 52, roller cones 72 on rear cutting head 52 are also offset with respect to roller cones 60 on front cutting head 50. Legs 74 and teeth 76 on rear cutting head 52 are generally longitudinally aligned with arms 58 and roller cones 60 on front cutting head 50. This arrangement aids in ensuring that rocks and soil through which cutting assembly 44 moves are denuded as effectively as possible. Furthermore, roller cones 72 on rear cutting head 52 are located a distance further outwardly away from the exterior surface of shaft 46 than are roller cones 60. Consequently, front cutting head 50 will cut a first diameter hole through the ground "G" and rear cutting head 52 will cut a second and larger diameter hole through the ground "G".

Housing 48 may include an annular sidewall 48*a* having a generally circular cross section that bounds and defines an interior chamber 48*b*. An annular flange 48*c* is provided at a front end of sidewall 48*a*. Flange 48*c* has generally the same interior diameter "D3" as the majority of the interior chamber 48*b* but the exterior diameter of flange 48*c*, generally indicated as diameter "D7" (FIG. 10), is greater than the exterior diameter of the sidewall 48*a* of housing 48. It should be noted that the roller cones 72 of rear cutting head 70 cut through the ground "G" to create a borehole 80B (FIG. 10) that is slightly larger than the exterior diameter of flange 48*c* and is much larger than the exterior diameter of sidewall 48*a* of housing 48. Consequently, flange 48*c* is substantially in direct contact with the surrounding ground and soil that defines borehole 80B. A gap 81 (FIG. 10) is defined between the ground and soil that defines borehole 80B and the exterior surface of sidewall 48*c*. Flange 48*c* is thus adapted to effectively "seal" the borehole 80B and substantially prevents any debris cut during boring operations with cutter assembly 44 from moving forwardly beyond rear cutting head 52. Flange 48*c* may be welded or otherwise secured to mounting plate 68 of rear cutting head 52 so that flange 48*c* and thereby housing 48 rotate in unison with rear cutting head 52 and shaft 46.

Housing 48 further comprises a back end 48*d* (FIG. 2) that gradually curves and narrows inwardly and a collar 82 is provided at a rearmost portion of housing 48. Collar 82 enables a casing segment, such as segment 36*b* to be secured to the rearmost portion of housing 48. As can be seen from FIG. 9B a rearmost section of back end 48*d* proximate collar 82 has an interior diameter "D4" that is smaller than the diameter "D3" of the forwardmost part of the housing 48. The diameter "D4" is also larger than the interior diameter "D5" of casing segment 36*b*. It should be noted that cutting assembly 44 is contemplated for use in cutting boreholes 80B (FIG. 10) that are somewhere between 12 inches and 18 inches in diameter.

Figure 10:
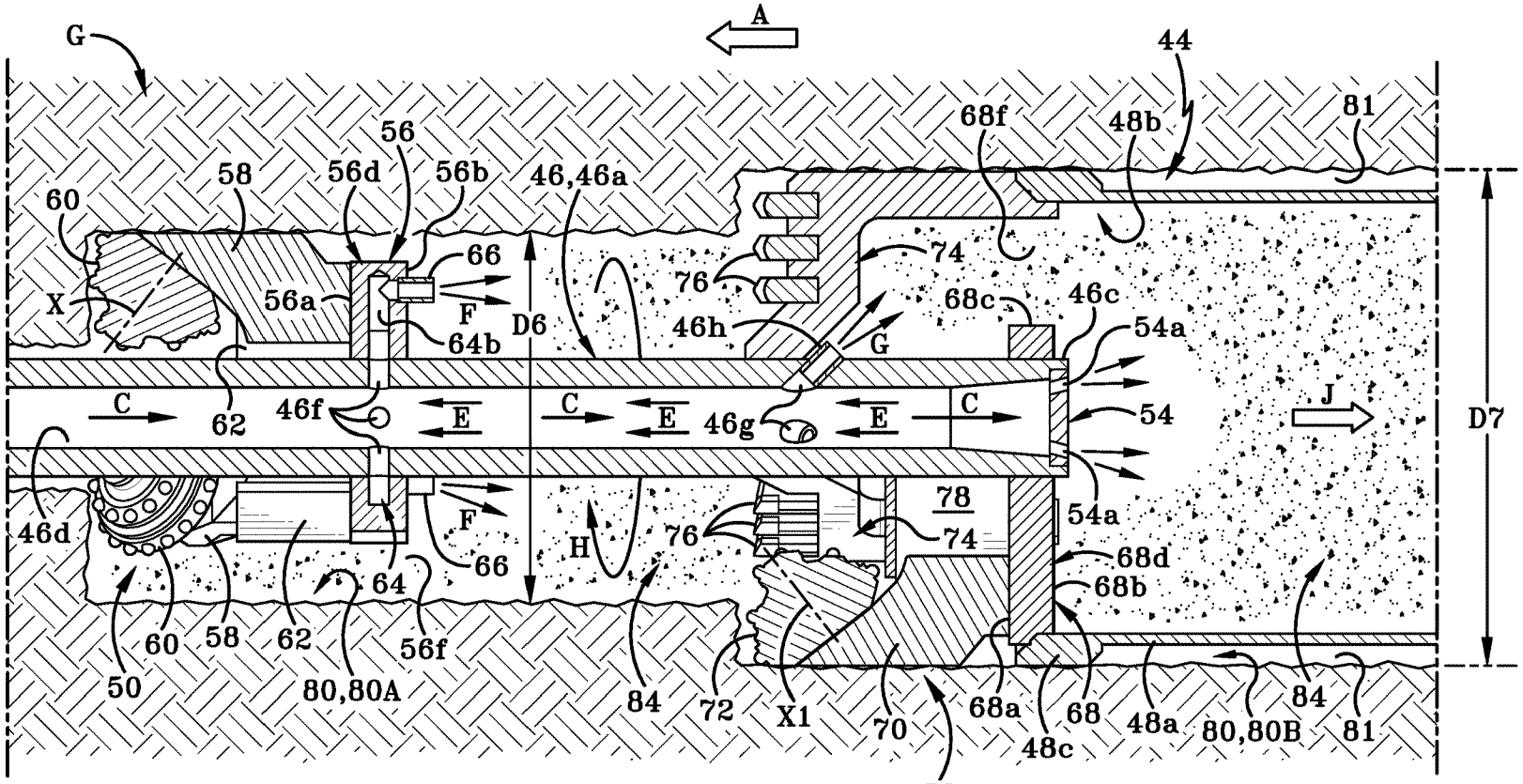
FIG. 10 is a longitudinal cross-sectional view of the cutting assembly in operation and showing the flow of spoil through the cutting assembly.

Referring to FIGS. 9A and 10, it should be noted that first cutting head 50 cuts a borehole 80A having a diameter "D6" (FIG. 10) and second cutting head 52 cuts a borehole 80B having a diameter "D7". The diameter "D7" is greater than the diameter "D6" because the second cutting head 52 is of a larger diameter than the diameter of first cutting head 40.

As seen in FIGS. 9A and 10, flange 48*c* on housing 48 is also of a diameter "D7" or maybe only marginally smaller than the diameter "D7" of borehole 80B. (Diameter "D7" is greater than any of the diameters "D", "D1", "D2", "D3", "D4", "D5", and "D6".) For all intents and purposes, flange 48*c* substantially seals borehole 80B because the diameter "D7" of flange 48*c* is approximately the same as the diameter "D7" of the borehole 80B cut by second cutting head 52.

Annular collar 82 is engaged with rearmost portion of housing 48. Collar 82 may help to rigidly secure housing 48 to casing segment 36*b*. Collar 82 may threadably engage casing segment 36*b* or may be welded thereto or may be connected by a plurality of fasteners (not shown) such as bolts or screws to casing segment 36*b*. (Similar collars and fasteners may be used between adjacent pairs of casing segments 36 to secure a given front end of one segment 36 to a given back end of another segment 36, whereby such collars may be used to secure segments 36 in the end-to-end fashion shown in FIG. 1B.)

With primary reference to FIGS. 1A, 1B and 10, the operation the system is now described. As shown and discussed previously with respect to FIG. 1, pilot tube 20 may be used to form pilot hole 18. This may be done in any manner known in the art. Pilot hole 18 may be formed by forcing and/or drilling with pilot tube 20 from first pit 12 to second pit 14 or in the opposite direction from second pit 14 to first pit 12. Thus, control assembly 14 might be used to drive pilot tube 20 from first pit 12 to second pit 14, or rig 30 may be used to drive pilot tube 20 from second pit 14 to first pit 12. As is well-known, this would be done by adding pilot tube segments 20*a*, 20*b*, 20*c*, etc. in an end-to-end fashion as the pilot hole 18 became longer. Once pilot tube 20 has formed pilot hole 18 such that one end of pilot tube 20 is exposed at first pit 12 and the other end exposed at second pit 14, the end exposed at second pit 14 is engaged with first end 46*b* of shaft 46 of cutting assembly 44. The other end of the pilot tube 20 exposed at first pit 12 is engaged with the swivel connector 28 that is in turn engaged with conduits 26 which connect to air source 22 and water source 24. Because of this configuration, when cutting assembly 44 is rotated about longitudinal axis "Y", then pilot tube 20 will rotate in unison with cutting assembly 44 and conduits 26 will remain stationary.

With the cutting assembly 44 engaged with the back end of the pilot tube 20 and with one or more casing segments 36 secured to the back of cutting assembly 44 and to engine 34; engine 34 of rig 30 may be operated to drive rotation of a drive shaft that is operatively engaged with casing segment 36*a*. Air source 22 is actuated in first pit 12 so that pressurized air flows through conduits 26, through the bore of pilot tube 20 and into the bore 46*d* of shaft 46 of cutting assembly 44. The airflow may be in the range of from about 900 cfm up to about 1600 cfm to be effective.

It will be understood that in some instances it may be desirable to utilize water to discharge cuttings from cutting assembly 44 through casing 36. In this instance, water source 24 will be actuated in first pit 12 so that pressurized water or any other suitable fluid flows through conduits 26, through the bore of pilot tube 20 and into the bore 46*d* of shaft 46 of cutting assembly 44.

As cutting assembly 44 is rotated about the longitudinal axis "Y" and is advanced in the direction of arrow "A" (FIG. 1A), roller cones 60 of front cutting head 50 cut and break up the ground "G". Tut material is fed rearwardly by rotating roller cones 60, arms 58 and V-shaped plates 62 through the associated spaces 56*f* in mounting plate 56 of front cutting head 40 to the region rearwardly of the rear surface 56*b* of mounting plate 56. At this point cutting assembly 44 is rotating in the direction of arrow "H" and is still advancing in the direction of arrow "A" through ground "G".

Some of the air and/or fluid flowing through bore 46*d* in the directions indicated by arrows "C" and "E" will be forced under pressure through passage 64 in mounting plate 56 and out through nozzles 66. The pressurized air and/or fluid will entrain the cut material and blow the same towards rear cutting head 52. The blown material passes through the rotating roller cones 72, cutting teeth 76, and plates 78 and be further broken up. That material as well as newly cut material (cut out of the ground "G" by the rotating roller cones 72, cutting teeth 76 and plates 78 of rear cutting head 52 will be forced through the spaces 68*f* in mounting plate 68 of rear cutting head 52. At this point the material previously cut by front cutting head 50 and the newly cut material cut by rear cutting head 50 will encounter the angled nozzles 46*h* blowing out air or fluid under pressure in the direction of arrow "G" (FIG. 10). The air or fluid blowing out of nozzles 46*h* will entrain additional cut material and force the same into the interior chamber 48*b* of housing 48. Additionally, pressurized air and/or fluid blows out of the holes 54*a* in the plate 54 at the second end 46*c* of shaft 46. The entrained cut material flows in the direction of arrow "J" through housing 48 and subsequently into the bore 37 (FIG. 9B) of casing segment 36*b*. Since all of the casing segments 36*b*, 36*c*, 36*d* through to the rearmost casing segment 36*a* have bores 37 that are in fluid communication with each other, the cut material (i.e., the spoil) entrained in the pressurized air and/or fluid blowing out of shaft and through housing 48 will feed into casing 36, and finally out of discharge port 40 on HDD rig 30. It should be noted that as the pressurized air and/or fluid is forced through nozzles 66, 46*h* and holes 54*a*, the speed of that pressurized air.

Since the spoil flowing in the direction of arrow "J" through housing 48 moves directly into casing 36, there is a substantially reduced chance of frac-out when this system is used. Furthermore, since flange 48*c* acts as a sealing surface and effectively substantially seals the borehole 80B that is cut in the ground "G", any cuttings 84, air and/or fluid that might inadvertently escape from casing 36 cannot flow forwardly and thereby be accidentally forced toward the surface as the cutting assembly 44 advances in the direction of arrow "A" through ground "G". The sealing flange 48*c* also aids in preventing air and/or fluid used during the boring operation from leaking into the environment and potentially damaging and contaminating the same. The flange 48*c* also ensures that the air and fluid that is forced through the first and second air passages through first and second cutting heads 50, 52 is under sufficient pressure to force cuttings 84 through housing 48 and into casing 36 to move the cutting 84 therethrough. If air and/or fluid can bleed around flange 48*c*, then the pressure on the cuttings 84 will be reduced and might be insufficient to move the cuttings 84 through the housing 48, through the casing 36 and out of the end 36*a* of casing 36 through discharge port 40 and hose 42.

A method of generally horizontally boring a borehole 80B (FIG. 10) may comprise steps of providing a cutting assembly 44 comprising a first cutting head 50 and a second cutting head 52; wherein second cutting head 52 is spaced a distance rearwardly behind first cutting head 50; rotating in the direction of arrow "H" and moving forward in the direction of arrow "A", the cutting assembly 44 and a casing 36 extending rearwardly from cutting assembly 44 to cut an underground borehole 80; and moving pressurized air in the direction of arrow "C" rearwardly through a first air passage 64, 64*a*, 64*b*, 64*c*, 66 formed in first cutting head 50 and through a second air passage 46*g*, 46*h* formed in second cutting head 52 and subsequently into a bore 37 (FIG. 9B) defined in casing 36 to discharge cuttings 84 (FIG. 10) created by the first and second cutting heads 50, 52 in a direction "J" and out of a rear end 36*a*, 40, 42 (FIGS. 1A, 1B and 2) of casing 36.

The method may further comprise a step of driving the rotation of the cutting assembly 44 and of the casing 36 in the direction of arrow "H" (FIG. 10) with a rotational output of an engine 34 adjacent the rear end 36*a* of casing 36. The step of rotating in the direction of arrow "H" and moving forward cutting assembly 44 and casing 36 in the direction of arrow "A" comprises pushing the rear end 36*a* of the casing 36 in the direction of arrow "A".

The method further comprises a step of providing a pilot tube 20 within an underground pilot hole 18 having a pilot hole diameter that is slightly larger than a diameter of the pilot tube; wherein the borehole 80A, 80B follows the pilot hole 18 and has a borehole diameter "D6", "D7" that is larger than the pilot hole diameter. The method further comprises a step of engaging the cutting assembly 44 and pilot tube 20 together in end-to-end relationship. This engagement causes pilot tube 20 to rotate in unison with cutting assembly 44 in the direction of arrow "H" and moving the pilot tube 20 in unison with the cutting assembly 44 in the direction of arrow "A".

The method further comprises engaging the pilot tube 20 with a first end 46*b* of a shaft 46 of cutting assembly 44 (FIG. 1B) and placing a bore of the pilot tube 20 in fluid communication with a bore 46*d* (FIG. 3) of shaft 46; and moving pressurized air from air source 22 through conduits 26, through the bore of pilot tube 20 into bore 46*d* of shaft 46 in the direction of arrow "C" (FIG. 10) and subsequently moving pressurized air from bore 46*d* of shaft 46 and into a first air passage 46*f*, 64, 64*a*, 64*b*, 64*c*, 66 in first cutting head 50.

The step of moving pressurized air through the bore 46*d* of shaft 46 further comprises creating backpressure in the direction of arrow "E" (FIG. 10) in bore 46*d* of shaft 46. The step of creating backpressure in the direction of arrow "E" comprises engaging a plate 54 defining a pattern of holes 54*a* therein at a second end 46*c* of bore 46*d* of shaft 46. The step of creating backpressure further comprises engaging one of a plurality of different plates 54 at second end 46*c* of the bore 46*d* of shaft 46, wherein each of the plurality of different plates, such as plate 54, defines a different pattern of holes 54*a* therein. An exemplary pattern of holes 54*a* may be seen in FIG. 8, though other patterns are possible. The plate 54 that is engaged with shaft 46 is selected by an operator based on a particular pattern of holes 54*a* arranged in the selected plate 54. The pattern of holes 54*a* in any particular plate 54 is selected on the basis of the terrain (i.e., type of rock, soil, ground, obstacles, etc.) through which borehole 80B is to be cut as the pattern of holes 54*a* will affect the strength of the backpressure generated within shaft 46. If a strong airflow is required to blow heavier, larger particle cuttings 84 through the cutting assembly 44, through casing 36 and out of discharge port 42, then a first configuration or pattern of holes 54*a* in plate 54 will be selected. If a less vigorous airflow is required to blow cuttings 84 (such as smaller, lighter particles like beach sand) through cutting assembly 44 and casing 36 and out of discharge port 42, then a plate 54 with a completely different pattern of holes 54*a* may be selected.

The method further comprises sealing the borehole 80B with a flange 48*c* provided rearwardly of second cutting head 52 on cutting assembly. The method further comprises providing a rearwardly tapered housing 48 (FIG. 9B) rearwardly of second cutting head 52 and attaching casing 36 to a rear end 48*e* of the tapered housing 48; and directing cuttings 84 in the direction of arrow "J" (FIG. 10) from second cutting head 52 through a chamber 48*b* defined by the tapered housing 48 and into casing 36. This directing of cuttings 84 is accomplished without using an auger in either of cutting assembly 44 or casing 36.

The method further comprises cutting a first diameter borehole 80A with first cutting head 50 and cutting a larger second diameter borehole 80B with second cutting head 52 and performing this cutting operation without withdrawing the cutting assembly 44 from the borehole 80A, 80B between the cutting of the first diameter borehole 80A and the cutting of the second diameter borehole 80B. In other words, the cutting of the two different diameter sections 80A, 80B of the borehole is accomplished in a single pass of cutting assembly 44.

The step of moving pressurized air through cutting assembly 44 occurs essentially without moving a liquid rearwardly through the first air passage, 46*f*, 64, 64*a*, 64*b*, 64*c*, 66; through the second air passage 46*g*, 46*h*, the interior chamber 48*b* of housing 48 and through bore 37 of casing 36.

Furthermore, the step of rotating in the direction of arrow "H" and moving forward in the direction of arrow "A" occurs without delivering a liquid adjacent the cutting assembly 44 other than liquid occurring naturally in ground through which cutting assembly 44 cuts borehole 80A, 80B. Additionally, wherein other than liquid occurring naturally in ground through which cutting assembly 44 cuts the borehole 80A, 80B, essentially no liquid is used to discharge from the borehole 80A, 80B cuttings 84 created by cutting assembly 44.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration set out herein are an example and the invention is not limited to the exact details shown or described.

The invention claimed is:

1. A method of cutting an underground borehole comprising steps of:

providing a cutting assembly comprising a first cutting head and a second cutting head; wherein the second cutting head is spaced a distance rearwardly behind the first cutting head;

rotating and moving forward the cutting assembly and a casing extending rearwardly from the cutting assembly to cut an underground borehole;

moving pressurized air rearwardly through a first air passage formed in the first cutting head and towards the second cutting head;

moving pressurized air rearwardly through a second air passage formed in the second cutting head and subsequently into a bore defined in the casing;

entraining cuttings created by the first and second cutting heads in the moving pressurized air; and discharging the cuttings entrained in pressurized air out of the casing without using an auger in either of the cutting assembly or the casing.

2. The method of claim 1 further comprising:

a step of driving the rotating and moving of the cutting assembly and the casing with a rotational output of an engine adjacent the rear end of the casing.

3. The method of claim 1 wherein the step of rotating and moving forward the cutting assembly and casing comprises pushing the rear end of the casing.

4. The method of claim 1, further comprising a step of:

providing a pilot tube within an underground pilot hole having a pilot hole diameter; wherein the borehole follows the pilot hole and has a borehole diameter larger than the pilot hole diameter; and engaging the cutting assembly and the pilot tube in end-to-end relationship.

5. The method of claim 4, further comprising rotating and moving the pilot tube in unison with the rotating and moving of the cutting assembly and casing.

6. The method of claim 4, further comprising:

engaging the pilot tube with a front end of the shaft of the cutting assembly;

placing a bore of the pilot tube in fluid communication with the bore of the shaft; and moving the pressurized air through the bore of the pilot tube into the bore of the shaft and subsequently moving the pressurized air from the bore of the shaft and into the first air passage.

7. The method of claim 1, further comprising:

sealing the borehole with a flange provided rearwardly of the second cutting head on the cutting assembly.

8. The method of claim 7, further comprising:

encouraging discharge cuttings to move through the casing while simultaneously precluding cuttings moving around the exterior of the flange.

9. The method of claim 1, further comprising:

providing a rearwardly tapered housing extending rearwardly from the second cutting head:

attaching the casing to a rear end of the tapered housing; and directing cuttings from the second cutting head through the tapered housing and into the casing.

10. The method of claim 9, wherein the step of directing the cuttings through the tapered housing and into the casing is accomplished without using an auger.

11. The method of claim 1, further comprising:

cutting a first diameter borehole with the first cutting head; and cutting a larger second diameter borehole with the second cutting head.

12. The method of claim 11, wherein the steps of cutting the first diameter borehole and cutting the second diameter borehole are accomplished without withdrawing the cutting assembly from the borehole between the cutting of the first diameter borehole and the cutting of the second diameter borehole.

13. The method of claim 1 wherein the step of moving pressurized air occurs essentially without moving a liquid rearwardly through the first air passage, the second air passage and the bore of the casing.

14. The method of claim 1 wherein the step of rotating and moving forward occurs without delivering a liquid adjacent the cutting assembly other than liquid occurring naturally in ground through which the cutting assembly cuts the borehole.

15. The method of claim 1 wherein other than liquid occurring naturally in ground through which the cutting assembly cuts the borehole, essentially no liquid is used to discharge from the borehole cuttings created by the cutting assembly.

16. A method comprising steps of:

providing a cutting assembly comprising a first cutting head and a second cutting head; wherein the second cutting head is spaced a distance rearwardly behind the first cutting head;

providing a pilot tube within an underground pilot hole having a pilot hole diameter; wherein the borehole follows the pilot hole and has a borehole diameter larger than the pilot hole diameter; and engaging the cutting assembly and the pilot tube in end-to-end relationship;

engaging the pilot tube with a front end of a shaft of the cutting assembly;

placing a bore of the pilot tube in fluid communication with a bore of the shaft;

moving pressurized air through the bore of the pilot tube into the bore of the shaft;

rotating and moving forward the cutting assembly and a casing extending rearwardly from the cutting assembly to cut an underground borehole;

moving the pressurized air from the bore of the shaft through a first air passage formed in the first cutting head and through a second air passage formed in the second cutting head; and subsequently moving the pressurized air into a bore defined in the casing to discharge cuttings created by the first and second cutting heads out of the casing; and wherein the step of moving pressurized air through the bore of the shaft further comprises creating backpressure in the bore of the shaft.

17. The method of claim 16, wherein the step of creating backpressure comprises engaging a plate defining a pattern of apertures therein at a rear end of the bore of the shaft.

18. The method of claim 17, wherein the step of creating backpressure further comprises engaging one of a plurality of different plates at the rear end of the bore of the shaft, wherein each of the plurality of different plates defines a different pattern of apertures therein.

19. The method of claim 18, further comprising the step of selecting the one of the plurality of different plates based on a terrain in which the cutting assembly is cut the borehole.

20. An apparatus comprising:

an earth-boring cutting assembly having a first cutting head and a second cutting head located rearwardly of the first cutting head; wherein the first cutting head is of a smaller diameter than the second cutting head;

a first air passage extending through the first cutting head;

a second air passage extending through the second cutting head;

a shaft having a first end and a second end and a bore defined therebetween; wherein the first cutting head and the second cutting head are mounted on the shaft and one or both of the first air passage and the second air passage is in fluid communication with the bore of the shaft;

a casing secured to the cutting assembly rearwardly of the second cutting head; wherein the casing extends rearwardly from the cutting assembly and wherein the casing and cutting assembly are rotatable together as a unit, and wherein the casing has a front end and a rear end;

a bore defined in the casing which extends from adjacent the front end to adjacent the rear end of the casing and which is in fluid communication with the first and second air passages; and a plate that extends across the second end of the shaft; wherein the plate defines a plurality of holes therein that each extend between an inner surface and an outer surface of the plate.

21. The apparatus as defined in claim 20, wherein the plurality of holes is arranged in a pattern.

22. The apparatus as defined in claim 21, wherein the pattern of the plurality of holes is selected based on a property of a terrain through which a borehole is to be bored using the cutting assembly.

23. The apparatus as defined in claim 20, wherein the cutting assembly further comprises a housing extending rearwardly from the second cutting head and wherein the housing is engaged with a front end of the casing.

24. The apparatus as defined in claim 23, wherein the housing tapers in diameter from proximate the second cutting head to proximate the casing.

25. The apparatus as defined in claim 23, further comprising an annular flange provided on a front end of the housing adjacent the second cutting head; wherein the flange extends radially outwardly for a distance beyond an exterior wall of the housing; and wherein the annular flange is adapted to approximate a diameter of the borehole to be cut by the second cutting head and to seal the borehole.

26. An apparatus comprising:

an earth-boring cutting assembly having a first cutting head and a second cutting head located rearwardly of the first cutting head;

a first air passage extending through the first cutting head;

a second air passage extending through the second cuffing head;

a casing secured to the cutting assembly rearwardly of the second cutting head; wherein the casing extends rearwardly from the cutting assembly and wherein the casing and cutting assembly are rotatable together as a unit, and wherein the casing has a front end and a rear end;

a bore defined in the casing which extends from adjacent the front end to adjacent the rear end of the casing and which is in fluid communication with the first and second air passages; and wherein the cutting assembly and casing are free of any augers that advance cuttings generated by the first and second cutting heads through the cutting assembly and the bore of the casing.

27. The apparatus as defined in claim 26, further comprising:

a shaft having a first end and a second end; and defining bore that extends from the first end to the second end;

wherein the first cutting head is provided on the shaft a distance rearwardly of the first end;

the second cutting head is provided on the shaft a distance rearwardly of the first cutting head; wherein the second cutting head is of a greater diameter than the first cutting head;

wherein the first and second air passages are in fluid communication with the bore of the shaft and wherein the bore of the shaft, the first air passage, and the second air passage are adapted to receive pressurized air therethrough.

28. The apparatus as defined in claim 27, further comprising:

a housing extending rearwardly from the second cutting head, said housing defining a chamber therein and with which the first and second air passages and the bore of the shaft are in fluid communication.

29. The apparatus as defined in claim 28, further comprising:

an annular flange concentric with the housing and extending for a distance outwardly away from the housing.

* * * * *